United States Patent [19]

Felix

[11] 3,994,118

[45] Nov. 30, 1976

[54] BUNDLING MACHINE FOR SHEET MATERIAL

[75] Inventor: Willi Felix, Strengelbach, Switzerland

[73] Assignee: Jos. Hunkeler AG, Graphische Maschinen, Wikon, Switzerland

[22] Filed: Feb. 24, 1976

[21] Appl. No.: 660,868

[30] Foreign Application Priority Data

Feb. 25, 1975 Switzerland ..... 2379/75

[52] U.S. Cl. ..... 53/124 D; 53/198 R; 100/15; 156/446

[51] Int. Cl.[2] ..... B65B 13/20; B65B 13/32

[58] Field of Search ..... 53/124 D, 124 E, 198 R, 53/211; 100/3, 15; 156/446

[56] References Cited

UNITED STATES PATENTS 3,513,628 5/1970 Lee et al. ..... 53/124 E 3,766,708 10/1973 Kubo et al. ..... 53/124 D

*Primary Examiner*—Travis S. McGehee

*Attorney, Agent, or Firm*—James E. Nilles

[57] ABSTRACT

A bundle of loose sheet material such as printed matter is produced by stacking the material; compressing the stack flatwise between pressure jaws; gripping the compressed stack at vertical transversely spaced edge portions thereof by an up and down movable clamping unit; releasing the pressure jaws; lifting the clamping unit and gripped stack above the released pressure jaws; wrapping banding tape around the lifted stack by rotating the lifted clamping unit and stack about a central vertical axis; lowering the clamping unit and stack; and finally opening the lowered clamping unit to release the banded stack.

10 Claims, 16 Drawing Figures

1

BUNDLING MACHINE FOR SHEET MATERIAL

BACKGROUND OF THE INVENTION

The present invention relates to a machine for compressing and banding stacks of sheet material, particularly paper cuttings and printed matter.

The output of automatic folding machines, gathering devices, adhesive stackers, rotary printing presses, automatic folding and assembling apparatus, stamping machines, trimmers and the like, must frequently be put up in bundles of counted sheets, and banded with tape, preferably of paper or synthetic material. Such bundling work has heretofore been performed amost exclusively by hand although the prior art includes automatic apparatus for banding stacks of individual labels. Such prior art apparatus, however, is not suitable for relatively large pieces such as printed folders and the like. Also, cord tying machines have been known for this kind of work, but these had the great disadvantage that the tied material was damaged by the cord. The manual work for banding the stacks requires effort and skill, and the quality of such manually banded stacks has generally been unsatisfactory because trapped air between the individual sheets could not be properly expelled and the stacks were too loose. Moreover, this type of production was inefficient.

SUMMARY OF THE PRESENT INVENTION

The machine embodying the present invention overcomes the above mentioned shortcomings of the prior art in that it provides for adhesive tape banding of stacked sheet material, particularly printed matter, and permits to perform this work mechanically in a fully satisfactory and expeditious manner. In this respect the machine is unique in that it incorporates a stack clamping unit and means for wrapping tape around the stack while it is retained by the stack clamping unit; as well as means for tightening the tape during the wrapping operation.

The problem of automatic bundling is dealth with by the CH-PS No. 468,919. Said PS is concerned with a device for gripping portions of paper stacks to the bundled but it mentions the subsequent bundling operation only in passing. In this connection, reference is made to previously known bundling machines wherein banding straps are welded together. In this type of machine, the stretched strap is wrapped around the stationary stack, which is a slow mode of operation. Therefore, this manner of bundling is unsatisfactory. CH-PS No. 429,573 discloses a packing for mechanically assembled label stacks, comprising a non-sticking wrapping tape which extends along three sides of the stack and a self-sticking joining tape. A fully automatic, fast, simple and foolproof operation, however, requires a single piece banding tape rather than a sectionalized one as contemplated by said CH-PS No. 429,573.

The bundling machine according to the present invention is preferably provided with two press jaws which are adjustable toward and away from each other and which are more particularly arranged in such a manner that the midpoint of the space between the jaws is always kept at the same place regardless of the thickness of the stack. The construction of the machine is thereby considerably simplified.

The invention further contemplates to provide the press jaws with approximately vertical main faces for compressing a stack which has broadsides in parallel relation to the jaw main faces. During the compression of the stack, this is, while the material to be banded is pressed together from opposite sides, the broadsides of the stack or its principal faces are presented parallel with the vertical main faces of the press jaws, and the bottom face of the stack which rests on a support is evened out. Thus, any air between the sheets or leaves of the stack can be expelled when the jaws are pressed toward each other.

The invention further contemplates the provision of a clamping unit which grips the stack to be banded at transversely spaced edge portions thereof. Sufficient space is left between the gripped edge portions of the stack for wrapping banding tape around an intermediate portion of the stack.

The invention further contemplates to lower the clamping unit from a raised position to the level of the press jaws; to grip the compressed stack; and to lift the compressed stack out of the opened press jaws. This operation precludes that the practically air free stack becomes air permeated again and that individual leaves or sheets become displaced relative to the remainder of the stack.

The invention further contemplates to provide the stack clamping unit with at least one drive mechanism, for instance, a rotary drive. Such provision establishes the basic principle of the machine in that the banding tape is not wrapped around the stationary stack, but in that the stack with the tape end attached to it is rotated so as to wrap the tape around it. This means that minimal masses are moved during a wrapping operation in which the stack as well as the tape participate.

The invention further contemplates to provide the stack clamping unit with two rotary sections which are symmetrically arranged relative to each other and each of which has its own drive mechanism, the rotation of the sections being synchronized, for instance by means of a shaft, pinions, and gear wheels. An advantage of such an arrangement is that leaves or sheets of relatively large dimensions will be prevented from turning edgewise relative to each other within the stack. In lieu of a single, centralized motor, the two sections of the clamping units are being rotated independently of each other, which however means that they will have to be synchronized. The provision of separate motors has the advantage that the motors can be relatively small and the construction of the machine will be relatively light because the synchronizing shaft merely serves as a balancing element rather than as a drive torque transmitting element.

A controlled retarding device for the feeding of the wrapping tape insures tight wrapping of the stack.

The invention further contemplates to provide the machine with controlled pinching clamps in order to press the leading end of the banding tape against the stack before the wrapping operation, and to hold the tape end in place during the banding operation. The holding of the leading end of the banding tape is an indispensible requirement in order to perform the banding operation in the contemplated manner; that is, by rotation of the stack. It is further contemplated to construct the pinching clamps in the form of swingable elements which bear laterally upon the banding tape. Due to this provision, it is possible to move the pinching elements away from the band after the leading and trailing ends of the band have been connected together at portions thereof between the pinching elements. In this manner, the banded stack may readily be released after the banding operation. Provisions are made to withdraw the unbanded stack from between the press jaws, preferably by a straight line upward movement of the clamping unit and gripped stack therein.

The invention further contemplates to provide means for severing the wrapping tape, for instance, by means of a sword-shaped cutting element. Further, provisions are made for placing the line of cut at a distance from the nearest stack edge so as to form a tab by which the wrapped tape may readily be torn apart in order to open the stack. This manner of severing the tape permits ready adjustment of the equipment to different stack sizes.

The invention further contemplates to control the closing of the clamping unit by means of limit switches and to control the swinging movement of the pinching clamps by the position of the clamping unit, for instance by simple contact, and by means of suitable gear wheels and shafts.

The invention further contemplates to provide the machine with a central actuating element, for instance a motor or hand wheel whereby most of the operating phases of the machine may simultaneously be regulated so as to take care of different stack formats. By means of such provisions, the machine may be conditioned to handle a new stack format in response to actuation of a hand lever or a push-button without the need for any major adaptation work.

The invention further contemplates to provide control means whereby the machine is locked as long as no stack is in place between the press jaws. Such control means protect the machine, for instance when the supply of stack material fails, in which case a shut-off device or alarm system will be triggered by the control means. Control means for the drive mechanism of the machine are arranged in such a manner that the banding unit will be released for rotation when the leading end of the banding tape is pressed against the stack. Success of each banding operation will thus be insured since the end of the banding tape is attached to a stack.

The construction of the machine is relatively simple since the same motor will operate to shift the clamping unit as well as to rotate it.

THE DRAWINGS

The foregoing features and advantages of the invention will become more clearly apparent as this specification proceeds with reference to the accompanying drawings, wherein.

DETAILED DESCRIPTION

The banding machine illustrated by the drawings comprises a machine housing 1 in which motor control apparatus and like accessories are mounted. Since such equipment is well known in the art, it is neither shown nor will it be explained in detail hereinbelow.

Figure 1:
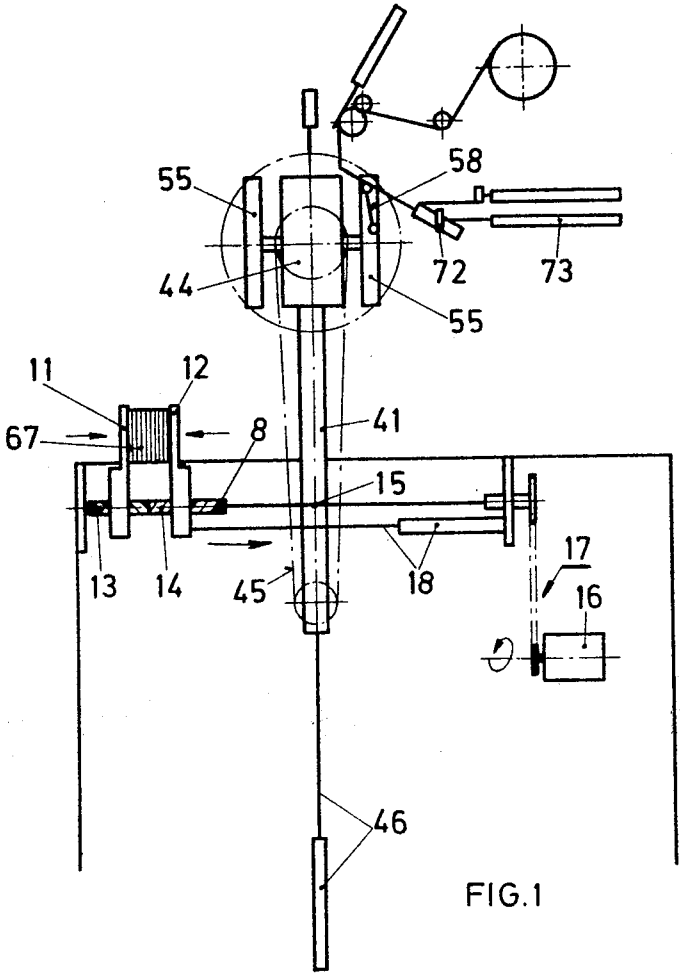
FIG. 1 is a schematic elevational view of a bundling machine embodying the invention, the machine being shown in a starting condition with a stack of sheets to be banded interposed between two press jaws in alignment therewith.
Figure 14:
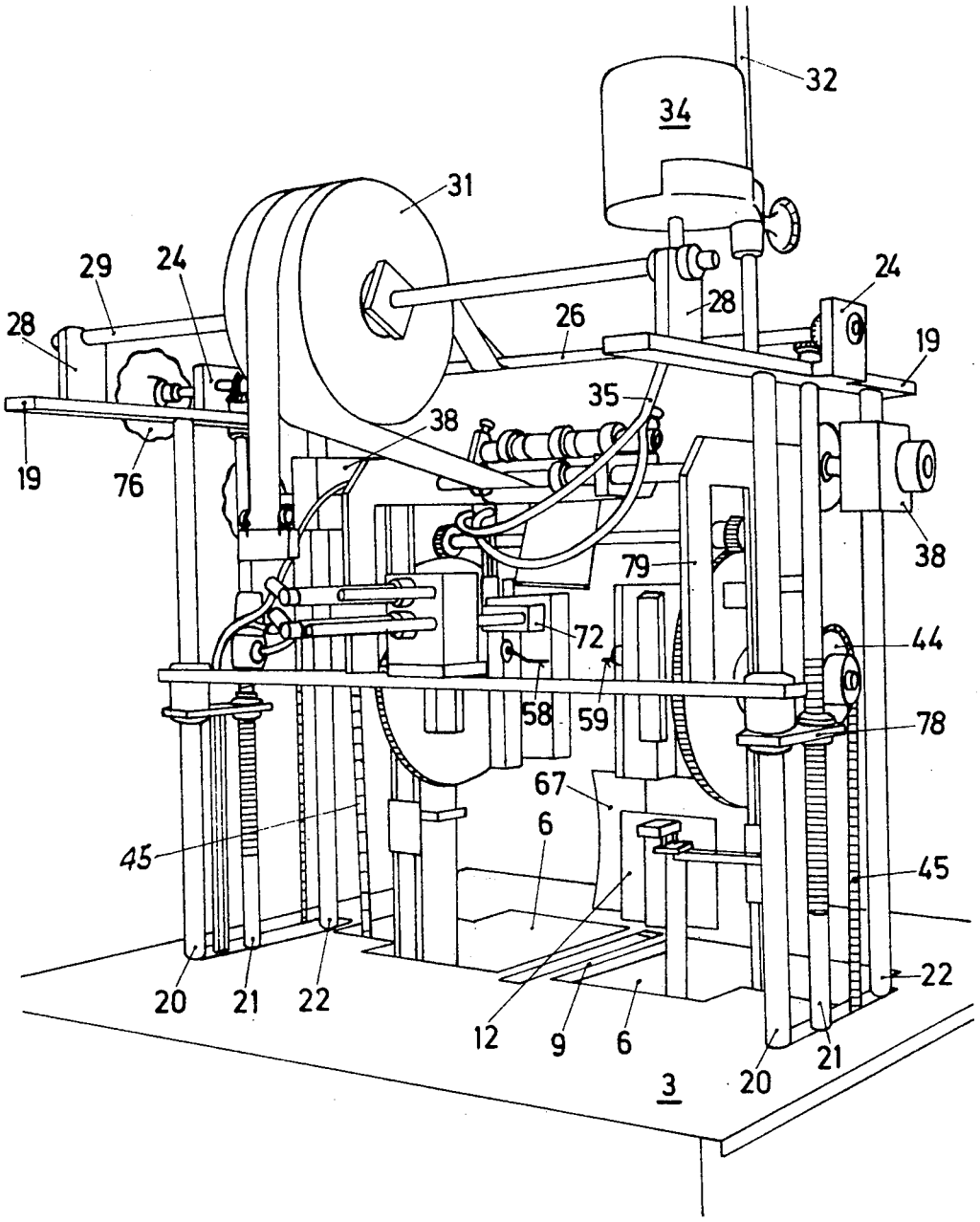
FIG. 14 is a simplified perspective three-quarter rear view of the upper part of a bundling machine embodying the invention; parts being omitted and the machine being shown in the operating condition corresponding to FIG. 1.

The upper end of the machine housing 1 is afforded by a table leaf 3 which is provided with a recessed channel 4. The table leaf 3 further has covered apertures 6. Mounted below the channel 4, as may be seen in FIGS. 1–7, is a spindle 8 which extends below guide rails (FIG. 14). This spindle 8 has secured to it for axial movement thereon two removable press jaws 11 and 12 which project upward from the machine housing 1, that is, from the table leaf 3; one press jaw having a threaded lug in cooperative engagement with a left-hand thread 13 of the spindle 8, and the other press jaw having a threaded lug in cooperative engagement with a right-hand thread 14 of the spindle 8. In FIG. 1, the reference character 15 designates the center at which the axis of the spindle 8 intersects a vertical plane through the pivot axis of a pair of turning clamps 55, 56

(FIG. 16) which will be explained more fully hereinbelow. A motor 16 (FIG. 1) is connected with the spindle 8 by a chain drive 17 and adjusts the press jaws 11 and 12 towards and away from each other. A piston and cylinder assembly 18 provides for bodily shifting of the spindle 8 and associated press jaws 11 and 12 as may be seen with reference to FIGS. 1 and 2.

Yokes 19 (FIG. 14) respectively bridge duplicate prop assemblies 20, 21 and 22. The props 21 afford partly threaded spindles. Mounted on the yokes 19, respectively, are angle clips 24 (FIG. 14) which rotatably support a horizontal shaft 29 which in turn carries a tape roll 31. One of the yokes 19 is further provided with a stand 32 for a glue container 34 which is adjustable up and down on the stand 32. A twin hose 35 leads to a pair of glue application nozzles 36 (FIG. 15).

Figure 15:
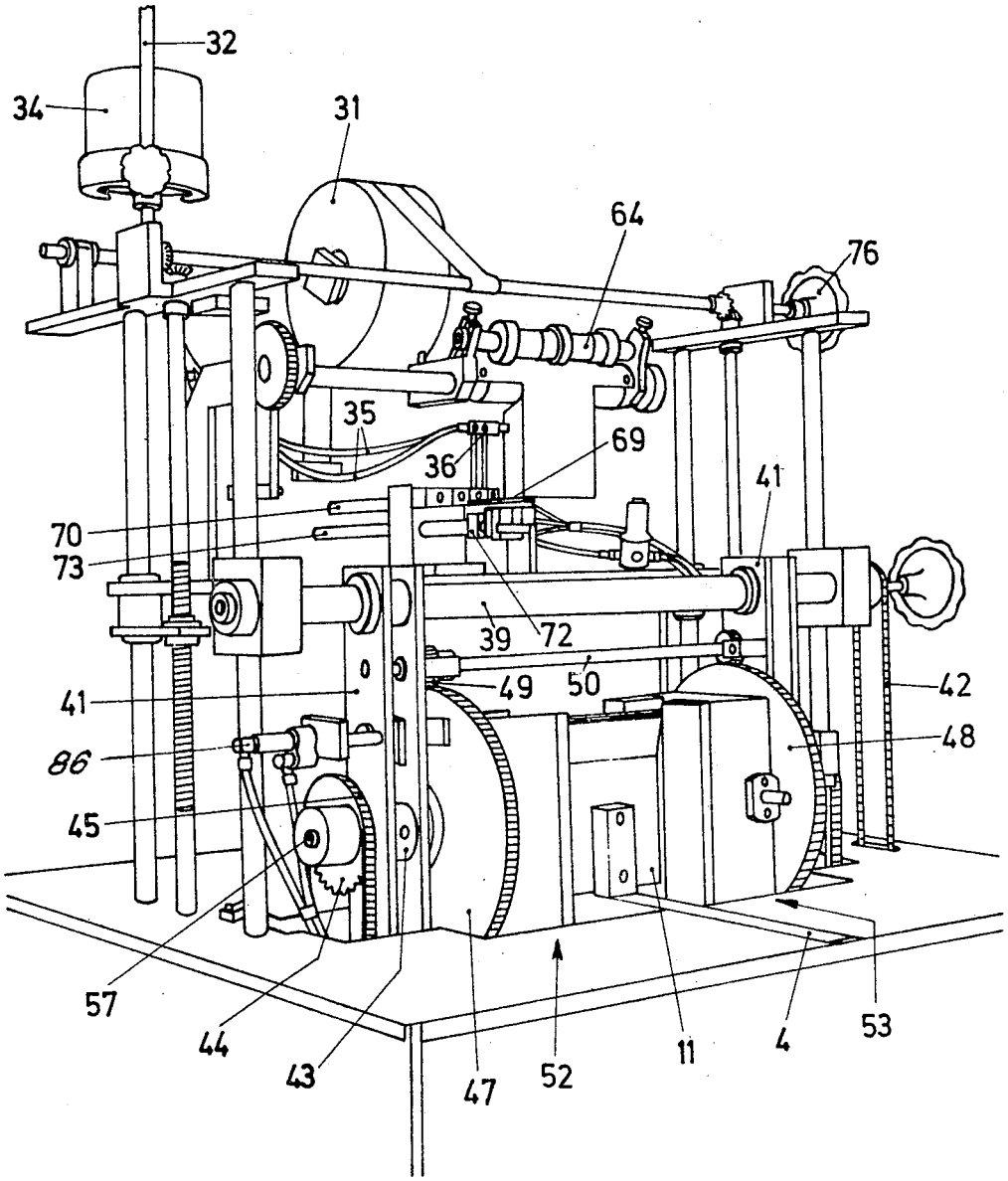
FIG. 15 is a perspective three quarter front view of the part of the machine shown in FIG. 14, the stack being shown in an advanced position corresponding to FIG. 2.

As shown in FIGS. 14 and 15, the props 22 mount shiftable guide blocks 38 which serve to support a horizontal shaft 39 (FIG. 15). Attached to the shaft 39 are downwardly extending dual support arms 41. FIG. 15 further shows a chain drive 42 which serves to shift the dual support arms 41 in parallel relation to each other for the purpose of adaptation to various stack formats.

Inserted into each dual support arm 41 is a bearing bushing 43 (FIG. 15) for the reception, in each bushing, of a hollow trunnion (not shown). Secured respectively to said hollow trunnions so as to face toward the center of the machine are bearing blocks 80 and 81 (FIG. 16) and large diameter gear wheels 47 and 48 (FIG. 15). Mounted respectively on the bearing blocks 80 and 81 (FIG. 16) by pairs of guide rods 82 and 83 (FIG. 16) are the stack turning clamps 55 and 56. Centralized adjustment of the turning clamp jaws toward and away from each other is effected by means of threaded spindles 84 and 85 (FIG. 16), respectively, which are each provided on one half thereof with a right-hand thread and on the other half with a left-hand thread. Driving power is transmitted to the threaded spindles 84, 85 by bevel gear drives (not shown) within the bearing blocks 80 and 81, respectively. The input gears of said bevel gear drives are each connected to a stub shaft 57 (FIG. 15) which is journaled in the respective hollow trunnion, and connected to each stub shaft 57 is a chain sprocket 44. Driving power is applied at each side of the clamping unit 51 (FIG. 3) by a separate motor, not shown, and by a drive chain 45. This arrangement has the advantage that even with stack ends of unequal thicknesses the stack ends are equally compressed, which is an indispensible requirement for a firm and uniform bundling of the stacks. The large diameter gear wheels 47 and 48 are interconnected by two synchronizing pinions 49 (FIG. 16) and a shaft 50. The gear wheel 47 may be stopped by a controlled locking device 86 (FIG. 15) so that no turning takes place during the tightening or loosening of the turning clamps 55 and 56. In order to rotate the wrapping unit 51 (FIG. 3) the gear wheel 47 is unlocked by means of a release mechanism 86 (FIG. 15) so that the turning motors will be able to turn the banding device by means of the chains 45 (FIG. 15) and the chain sprockets 44.

Figure 12:
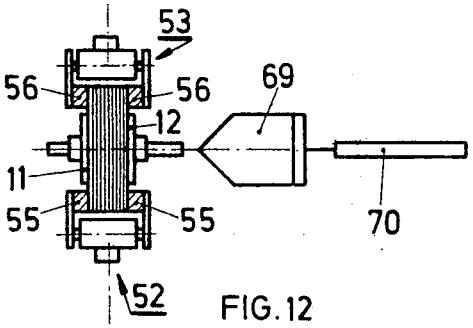
FIG. 12 is a schematic top view of the clamping unit; the upper portions of the unit being omitted and the unit being lowered in accordance with FIG. 2, and the severing knife being retracted.
Figure 13:
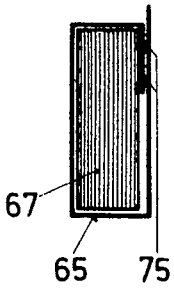
FIG. 13 is a schematic view of the stack wrapped by the banding tape whose ends are joined together by glue patches.

The two rear jaws of the turning clamps 55 and 56 (FIG. 16) carry two pinching cranks 58 and 59 which are actuated in conformity with the operating program by control rods 61 (FIG. 16) and control heads 62. Within the range of the tape roll 31 (FIG. 15) the machine is provided with a tape feeding mechanism 64 which pulls a tape 65 (FIG. 16) from the roll 31. As further illustrated by FIG. 16, the stack 67 is supported by transversely spaced side portions thereof by the jaws of the turning clamps 55 and 56, the stack being shown half wrapped by the tape 65 upon a 180° turn thereof. In this condition the two pinching cranks 58 and 59 hold the free end of the tape 65. A lance shaped severing knife 69 is shown schematically in FIG. 12 and as also indicated in FIG. 15 is adjustable up and down directly above the upper edge of the stack 67; the knife being transversely movable back and forth for cutting. Actuation of the knife 69 is accomplished by means of a pneumatic operating mechanism 70 (FIG. 15) also shows a press plunger 72 and an associated actuating mechanism 73, the plunger 72 being operable to press the tape ends together for gluing them to each other at the end of the banding operation. The gluing is done, as mentioned, with patches 75 which are clearly shown in FIG. 16.

A handwheel 76 (FIGS. 15 and 16) is operable to adjust the entire working assembly up and down. To that end the spindles 21 are turned by bevel gears associated with the shaft 26 (FIG. 14). Rotation of the spindles 21 raises and lowers brackets 78 (FIG. 14) and associated upright plate members 79 to cause up and down adjustment of the tape feeding mechanism 64 (FIG. 15) in unison with the severing knife 69 and the glue dispensing nozzles 36, for the purpose of locating these components at a height in conformity with the height of the stack of sheet material 67 (FIG. 14). Rotation of the spindles 21 by means of the handwheel 76 also causes adjustment of the turning clamps 55 and 56 to the middle axis of the stack 67 whose location varies with the height of the stack. The lower mounting of the spindles 21 is installed in the machine housing 1 and not shown in the drawings.

In lieu of the handwheel 76 a driving motor may be provided which by means of a limit switch within the machine housing provides for a centralized adjustment of the machine. To that end the central clamping jaws of the turning clamps 55, 56 are adjusted up and down as well as the severing knife 69 together with the press plunger 72. At the same time the throw of the tape feeding device is adjusted to the required length and the glue dispensing nozzles 36 are correspondingly adjusted.

OPERATION

Figure 11:
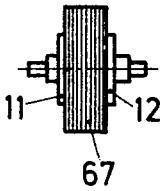
FIG. 11 is a schematic view showing the banded stack between the two press jaws.

The machine for pressing and banding stacks of sheet material, particularly printed matter, which has been disclosed hereinabove with reference to its essential components operates as follows:

The material issued by the production machine is manually or automatically placed in stacked condition between the press jaws 11 and 12, the stack being oriented so that long edges of the sheets or leaves to be bundled face upward. For the purpose of adapting the machine to the length dimension of the stack 67 to be bundled the jaws 11 and 12 are removable and replaceable by others of a different shape, the size of the selected jaws being such that the stack 67 projects a substantial distance at both sides beyond the press jaws as clearly shown in FIGS. 11 and 12. As the next step the press jaws 11 and 12 are closed either by a foot pedal or by suitable automatic equipment controlled by limit switch and timing means, not shown. At the same time the spindle 8 (FIG. 1) is rotated by the motor 16 and the associated chain drive 17. As a result the jaws 11 and 12 are equally displaced with reference to a constant center plane. The stack 67 is thus compressed and since it is practically exposed at all sides any air between its lamination can readily escape. This phase is illustrated by FIG. 1.

As the next step the compressed stack 67 is horizontally displaced and positioned immediately below the turning clamps 55 and 56. This is accomplished by controlled operation of the piston-cylinder assembly 18 which shifts the jaws 11 and 12 with the compressed stack 67 therebetween from the FIG. 1 to the FIG. 2 position.

Figure 2:
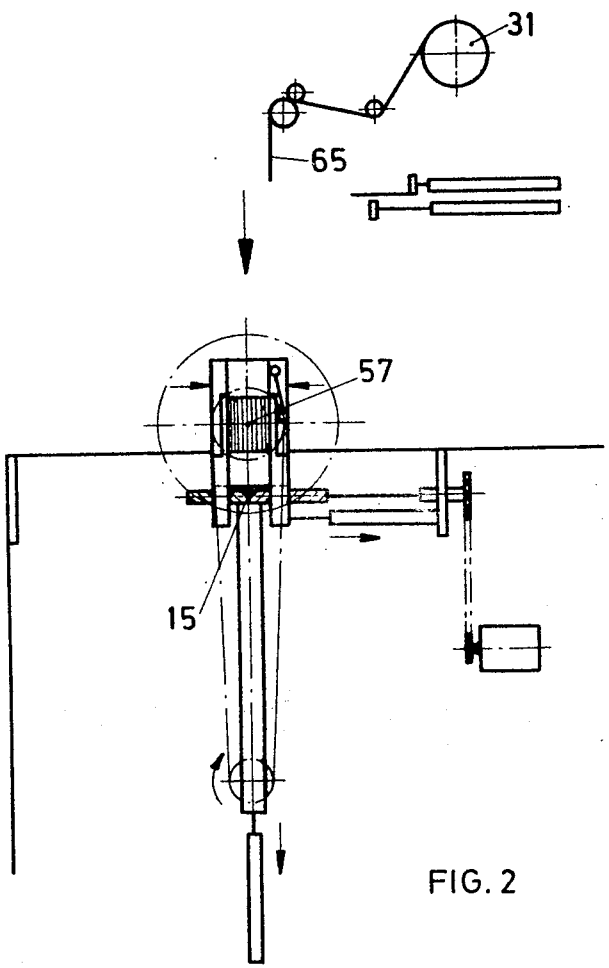
FIG. 2 is a schematic view like FIG. 1 showing the compressed stack shifted to a position between the jaws of a lowered clamping and turning unit for gripping the two free ends of the stack.
Figure 3:
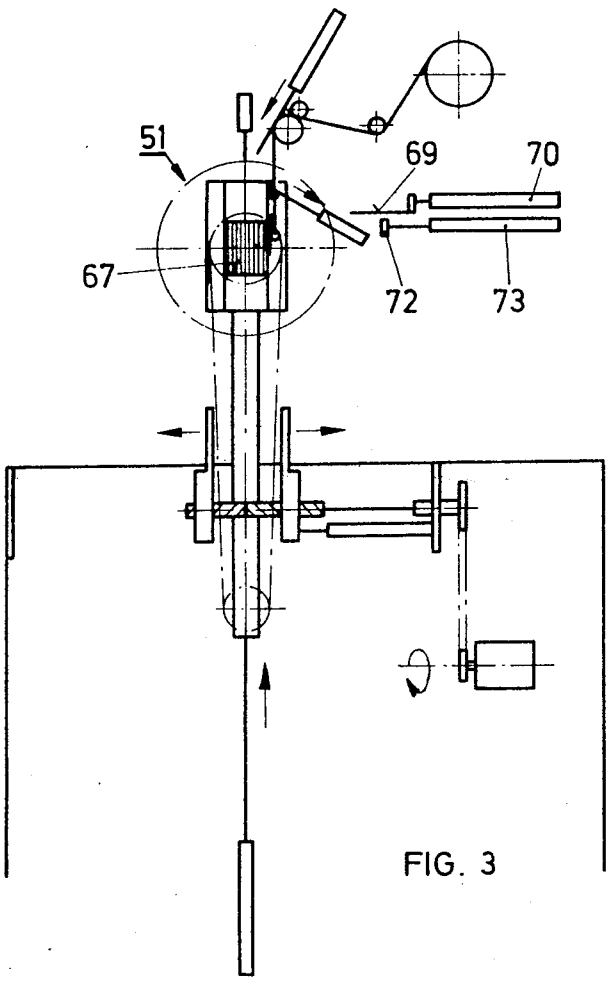
FIG. 3 is a schematic view like FIG. 1 showing the press jaws open and the clamping unit raised together with a gripped stack; and also showing advanced banding tape and pinching cranks for holding the leading tape end on the stack to be banded.
Figure 6:
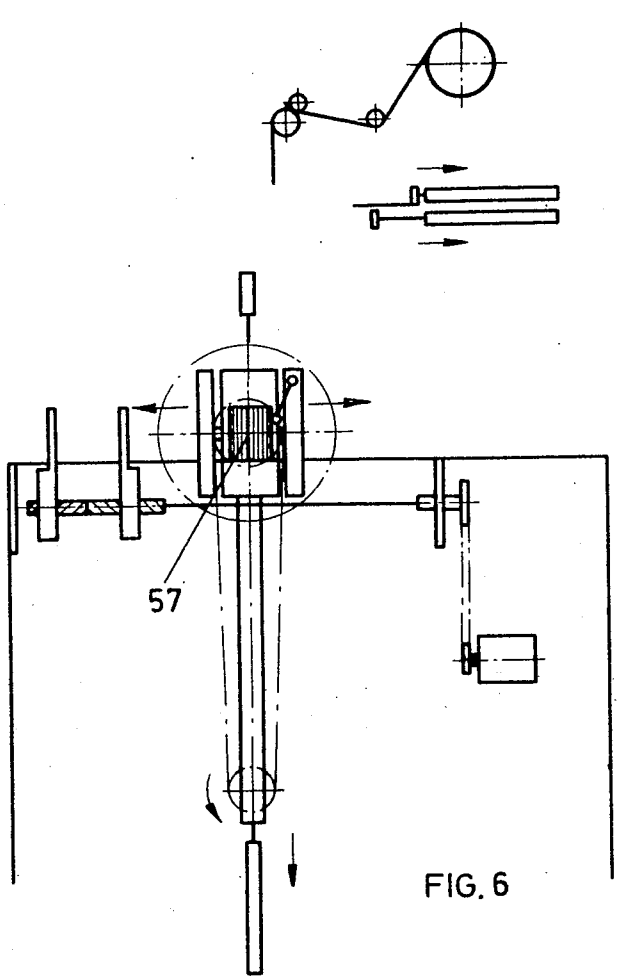
FIG. 6 is a schematic view like FIG. 1 illustrating the clamping unit lowered and the banded stack released.

As the next step the whole wrapping section, including the clamping assemblies 52 and 53 (FIG. 15), is lowered in accordance, for instance, with a predetermined control program, such lowering of the wrapping section placing it into its FIG. 2 position which is also shown in FIG. 15. During such lowering of the wrapping section the turning clamps 55 and 56 straddle the laterally free end portions of the stack 67 and the jaws of the turning clamps are then closed and grip the stack 67 at its transversely spaced end portions. Subsequently, the two press jaws 11 and 12 are opened by reverse rotation of the motor 16 (FIG. 3). Thereafter, controlled operation of the piston-cylinder assembly 46 (FIG. 1) raises the entire clamping and wrapping section 51 (FIG. 3) together with the stack 67 which is retained between the closed jaws of the turning clamps 55 and 56. When the wrapping section 51 has been raised the tape 65 is pushed ahead in accordance with the predetermined operating program of the machine until its leading end arrives somewhat below the middle of the stack 67 as illustrated by FIG. 3. Thereafter, the two pinching cranks 58, 59 (FIG. 16) are swung upon this end of the tape and press it flatwise upon the stack 67 as illustrated by FIG. 16.

Figure 4:
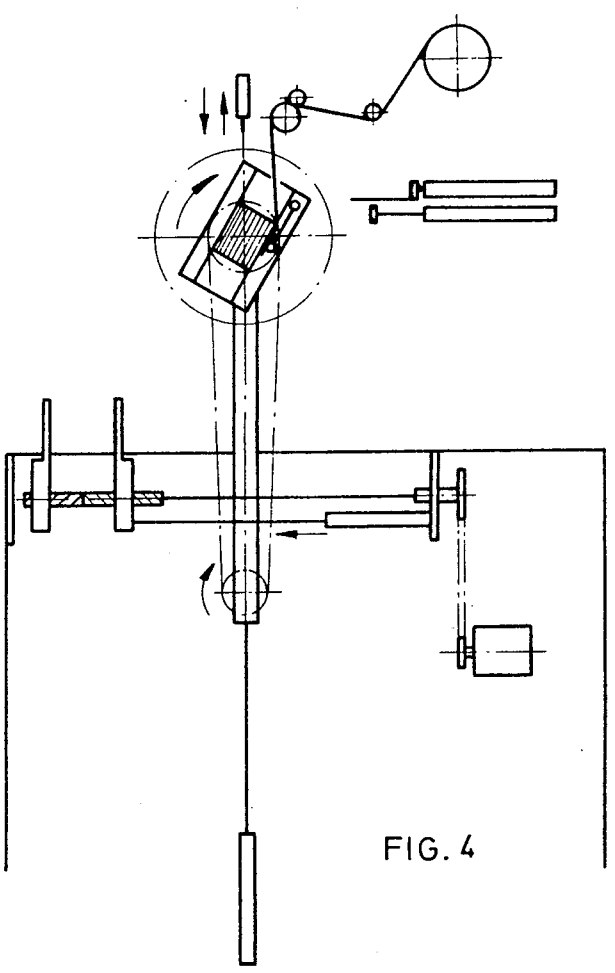
FIG. 4 is a schematic view like FIG. 1 illustrating the banding operation during which the clamping unit together with the gripped stack rotate and thereby wrap the trailing banding tape around the stack.
Figure 16:
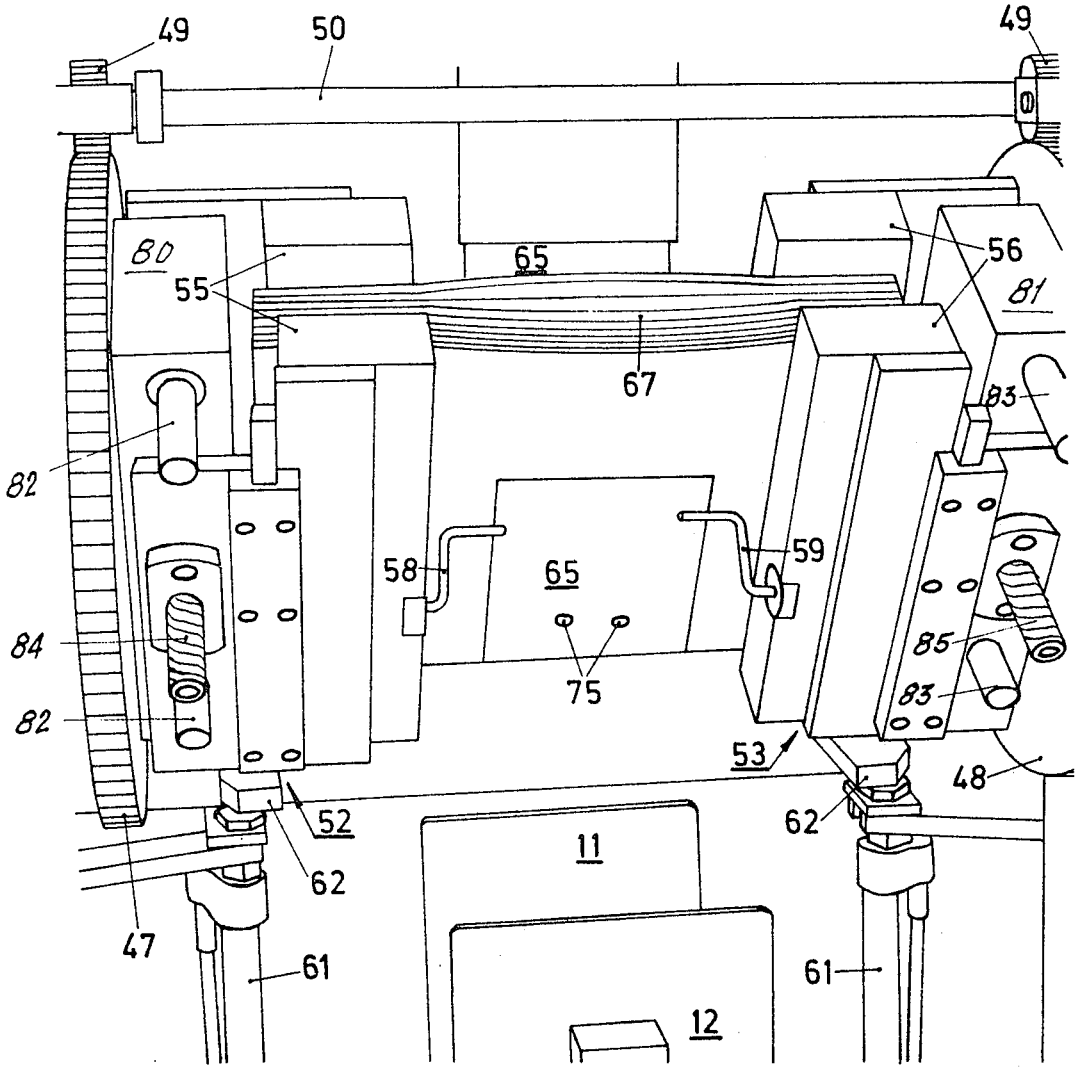
FIG. 16 is a perspective side view of parts of the machine according to FIG. 2 showing the stack rotated through one half revolution during the banding operation and in an intermediate position according to FIG. 4.

The rocking of the two pinching cranks 58 and 59 is accomplished by the two control rods 61 and control heads 62 shown in FIG. 16. A suitable impulse is now emitted which starts the driving motors for the wrapping section 51 (FIG. 3), the ensuing rotation of the motors being transmitted by the chains 45 (FIG. 14) to the sprockets 44 and associated stub shafts 57. As a result the two large diameter gear wheels 47 and 48 rotate, their rotation being synchronized by the pinions 49 (FIG. 16) and shaft 50. During such rotation of the gear wheels 47, 48 the tape 65 is trailingly delivered by the tape feeding device 64; one half of this operating phase being illustrated by FIG. 16. FIG. 4 shows this wrapping process in a schematic manner. During the wrapping of the tape 65, its withdrawal from the roll 31 is controllably restrained so that the tape will be wrapped around the stack 67 in a well tightened condition.

Figure 5:
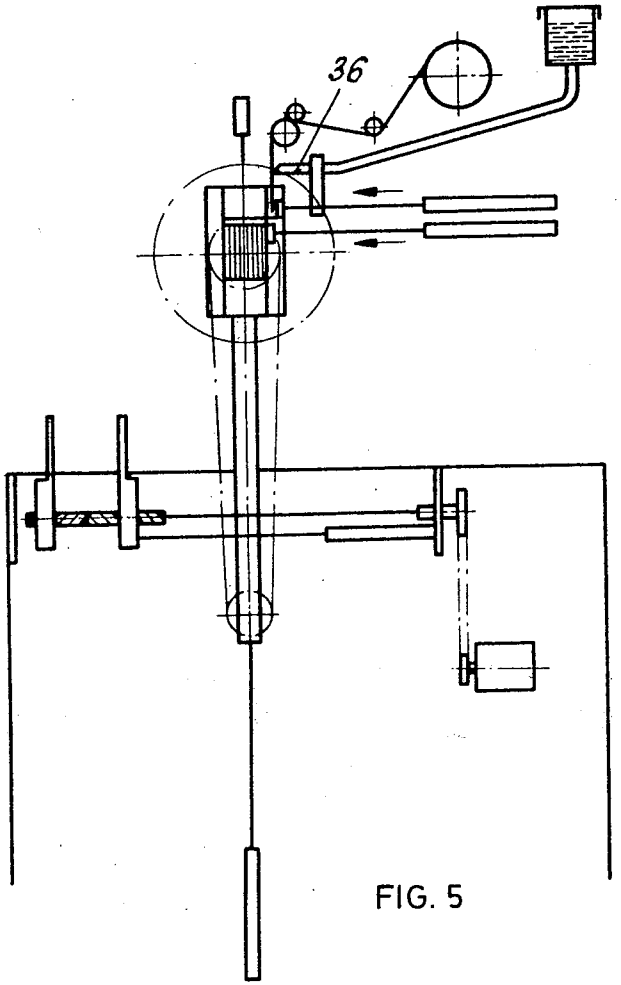
FIG. 5 is a schematic view like FIG. 1 showing the clamping unit rotated through a turn of 360° together with the banded stack, immediately before the banding tape is severed above the stack and before adhesive patches are applied to the leading end of the banding tape for the next stack.

As soon as the wrapping section 51 has completed a 360° turn and has resumed its FIG. 5 position the piston and cylinder assembly 73 (FIG. 15) is pneumatically actuated, for instance in accordance with a predetermined operating program. The plunger 72 is thereby pressed upon the tape 65 so that the tape is glued up by the glue patches 75.

While the plunger 72 presses the tape upon the stack 67 the severing knife 69 is moved by the piston and cylinder assembly 70 (FIG. 15) toward the wrapping unit 51 (FIG. 3). The severing knife separates the tape 65 with a clean cut and preferably in such a manner that a small overhanging tab is left at the top of the stack by means of which the tape may later readily be torn from the stack in order to open it. In unison with the movement of the knife 69 the glue dispensing nozzles 36 (FIG. 15) are brought against the tape. They apply the glue patches 75 for the banding of the next stack. In FIG. 5 these three operations are illustrated as they take place during and after their performance.

Figure 7:
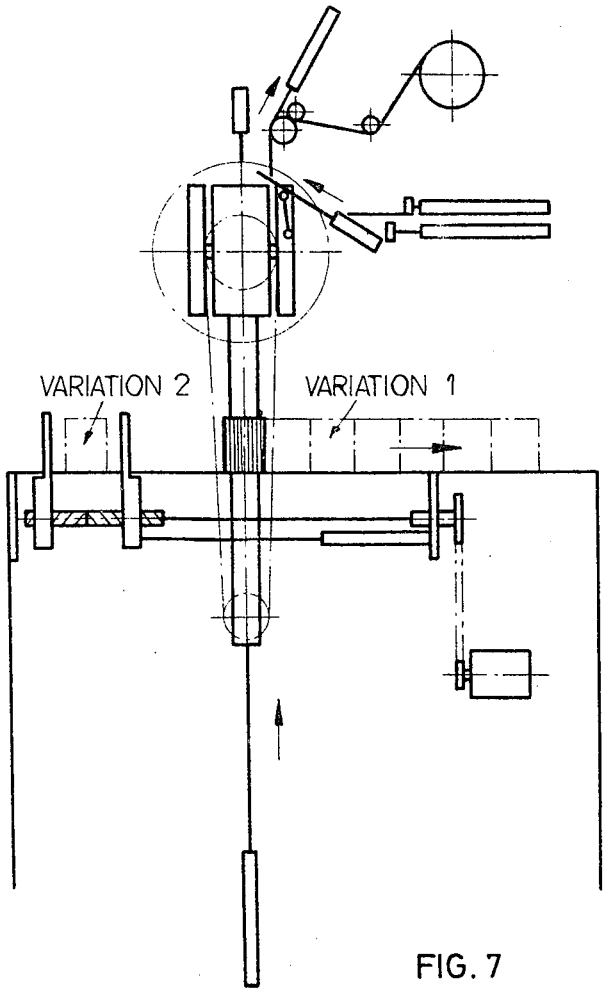
FIG. 7 is a schematic view like FIG. 1 illustrating Variation 1 the return of the banded stack into the starting position and its insertion between the open press jaws; and also illustrating at Variation 2 the transfer of the banded stack to the other side of the machine for transfer to a shipping station.
Figure 8:
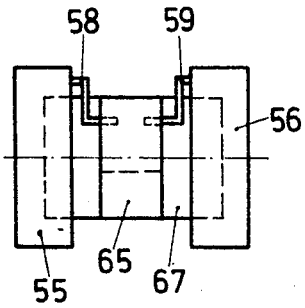
FIG. 8 is a schematic view of the rotatable clamping unit with a stack gripped by it, together with the banding tape and pinching cranks for retaining the leading end of the banding tape of the stack.
Figure 9:
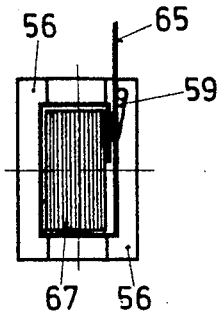
FIG. 9 is an end view of FIG. 8, the turning gear at one side being omitted.
Figure 10:
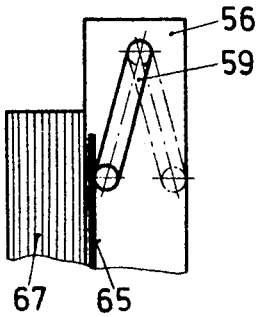
FIG. 10 is an enlarged view of part of FIG. 9 showing a pinching crank swung into an operative position.

During the next operating step the clamping and wrapping unit 51 together with the banded stack 67 is lowered upon the table plate 3 by means of the piston and cylinder assembly 46 (FIG. 1); the unit 51 with the turning clamps 55 and 56 is opened and raised into the starting position in which it is shown in FIGS. 1 and 7. In accordance with a first embodiment of the invention the banded stack 67 is shifted to the right as seen in FIG. 7, whereas according to a second embodiment of the invention the banded stack is withdrawn to the left at the front of the machine and is there transferred to a shipping station.

A machine of the herein disclosed character may if desired be equipped with a follow up control system, for instance by means of suitable limit switches and timing devices. However, since such a follow up control system involves well known engineering principles it forms no part of the present invention and an explanation thereof if therefore omitted.

In this sense it is also contemplated to provide control devices a first one of which prevents the press jaws 11 and 12 from being moved under the clamping and wrapping unit 51 as long as no stack to be banded is gripped between the press jaws 11 and 12.

The adaptation of the machine to the formats of the stacks is possible in an extremely simple manner. To that end the axis of the turning clamps 55, 56 can be adjusted by turning of the handwheel 76 (FIG. 14) and resulting rotation of the spindles 21. Simultaneously a corresponding synchronous adjustment of the glue dispensing nozzles 36, of the press plunger 72 and of the severing knife 69 will take place.

As may be seen from FIG. 16, the glue patches 75 are located inside the operating ranges of the two pinching cranks 58, 59 so that following upward adjustment of the clamping and wrapping unit 51 these pinching cranks 58, 59 may readily move upward and so that upon disengagement of the control rods 61 and control heads 62 the pinching cranks 58, 59 will under spring bias be swung back into outwardly cocked positions.

The banded stack can be selectively placed between the open press jaws and returned to the loading station, or the empty press jaws may be returned to the starting position while the wrapping tape is being advanced so that a new stack may already be inserted during the wrapping, severing and depositing operations.

Particular attention is being directed to the great importance which attaches to the formation of the stack between the press jaws 11 and 12. Due to the fact that the broadsides or large faces of the leaves, sheets or the like extend parallel with the vertical faces of the press jaws the bundling becomes satisfactory and during the incidental compression a stack without air occlusion is obtained. As a result, a later loosening of the banded stack is prevented.

I claim:

1. A machine for bundling loose pieces of sheet material, comprising:

pressure means operable to compress a stack of said sheet material flatwise from opposite sides thereof;

banding means adapted to grip said compressed stack flatwise at transversely spaced side portions thereof projecting from said pressure means; to withdraw said gripped stack from said pressure means; and to rotate said withdrawn stack on a turning axis extending through said transversely spaced side portions thereof; and banding tape feeding means operable to attach a continuous length of banding tape to said stack intermediate said transversely spaced side portions thereof.

2. A machine as set forth by claim 1 and further comprising fastening means or said banding tape operatively associated with said banding means so as to attach a leading end of said banding tape to said gripped and withdrawn stack prior to rotation thereof about said turning axis.

3. A machine as set forth by claim 2 and further comprising glue dispensing means operatively associated with said banding means so as to form a glued joint between said leading end and a portion of said tape which is brought into over-lapping engagement with said leading tape end by said rotation of said gripped and withdrawn stack about said turning axis.

4. A machine as set forth by claim 2 and further comprising tensioning means for said banding tape operatively associated with said banding means so as to restrain lengthwise movement of said banding tape toward said gripped and withdrawn stack while the latter is being rotated in tape wrapping direction about said turning axis.

5. A machine as set forth by claim 2 and further comprising severing means for said banding tape operatively associated with said banding means so as to execute a tape cutting cycle upon completion of a full turn of said gripped and withdrawn stack about said turning axis.

6. A machine for banding loose pieces of sheet material, comprising:

a machine frame;

a pair of upright press jaws operatively mounted on said frame for shifting movement toward and away from each other on a first horizontal axis;

a stack clamping and lifting unit operatively mounted on said frame for up and down adjustment relative to said press jaws; said unit comprising two pairs of clamping jaws operable, respectively, to grip transversely spaced end portions of a stack of said sheet material compressed between said press jaws, and to lift said compressed stack from said press jaws;

turning means operatively associated, respectively, with said pairs of clamping jaws for rotating the latter on a second horizontal axis extending perpendicularly to a vertical plane through said first horizontal axis;

banding tape feeding means operatively mounted on said frame for advancing banding tape toward a stack of compressed sheet material gripped by said pairs of clamping jaws; and banding tape fastening means operatively associated with said stack clamping and lifting unit for attaching the leading end of said banding tape to said stack of sheet material gripped by said pairs of clamping jaws.

7. A machine as set forth by claim 6 and further comprising separate drive means operatively associated, respectively, with said turning means, for rotating said pairs of clamping jaws about said second horizontal axis.

8. A machine as set forth by claim 7 and further comprising synchronizing means operatively associated with said turning means for said pairs of clamping jaws.

9. A machine as set forth by claim 7 and further comprising actuating means for said pairs of clamping jaws operatively associated, respectively, with said separate drive means.

10. A machine as set forth by claim 9 and further comprising releasable lock-out means for said turning means whereby said pairs of clamping jaws may be secured against rotation while said pairs of clamping jaws are moved into and out of gripping engagement with a compressed stack of said sheet material.

* * * * *